US007168348B2

(12) United States Patent
Holland-Letz

(10) Patent No.: US 7,168,348 B2
(45) Date of Patent: Jan. 30, 2007

(54) SCREWDRIVER BITS

(75) Inventor: Horst Holland-Letz, Neustadt (DE)

(73) Assignee: Felo Werkzeugfabrik Holland-Letz GmbH, Neustad (DE)

( * ) Notice: Subject to any disclaimer, the term of this patent is extended or adjusted under 35 U.S.C. 154(b) by 105 days.

(21) Appl. No.: 10/441,135

(22) Filed: May 19, 2003

(65) Prior Publication Data

US 2004/0139829 A1 Jul. 22, 2004

Related U.S. Application Data

(63) Continuation of application No. 09/992,900, filed on Nov. 6, 2001, now abandoned, which is a continuation-in-part of application No. PCT/DE01/00852, filed on Mar. 6, 2001.

(30) Foreign Application Priority Data

Mar. 6, 2000 (DE) ..... 100 10 311

(51) Int. Cl.
*B25B 23/00* (2006.01)

(52) U.S. Cl. ..... 81/460; 81/436

(58) Field of Classification Search ..... 81/460, 81/438, 436, 467
See application file for complete search history.

(56) References Cited

U.S. PATENT DOCUMENTS

| | | | | | |
|---|---|---|---|---|---|
| 1,977,845 | A | * | 10/1934 | Emmons | 76/108.2 |
| 2,366,682 | A | * | 1/1945 | West et al. | 81/460 |
| 2,804,894 | A | * | 9/1957 | Rosenburg | 81/436 |
| 3,393,722 | A | * | 7/1968 | Windham | 81/438 |
| 3,888,144 | A | * | 6/1975 | Parsons | 81/436 |
| 3,891,017 | A | * | 6/1975 | Iskra | 81/436 |
| 3,985,170 | A | * | 10/1976 | Iskra | 81/438 |
| 5,259,280 | A | * | 11/1993 | Hoy | 81/436 |
| 5,704,261 | A | * | 1/1998 | Strauch et al. | 81/467 |
| 5,868,047 | A | * | 2/1999 | Faust et al. | 81/438 |
| 6,185,771 | B1 | * | 2/2001 | Trusty, Sr. | 7/128 |
| 6,352,011 | B1 | * | 3/2002 | Fruhm | 81/438 |
| 6,379,710 | B1 | * | 4/2002 | Badylak | 424/553 |

FOREIGN PATENT DOCUMENTS

| | | | |
|---|---|---|---|
| DE | 70 44 913 | | 4/1970 |
| DE | 92 02 273.1 | | 7/1993 |
| DE | 4 241 005 | A1 * | 6/1994 |
| DE | 4 300 446 | A * | 6/1994 |
| DE | 19628 901 | A1 | 1/1998 |
| EP | 0439501 | | 8/1991 |
| FR | 2469 250 | A | 5/1981 |
| WO | WO 01/66312 | A1 | 9/2001 |

* cited by examiner

*Primary Examiner*—Hadi Shakeri
(74) *Attorney, Agent, or Firm*—Leydig, Voit & Mayer, Ltd.

(57) ABSTRACT

The invention pertains to a screwdriver bit with a drive section (14) and a front section (1) that contains a profiled penetrating section (2) and is manufactured by compression molding and subsequently sintering a hard metal powder, where the front section is connected to the drive section. Thus, according to the invention, the length of the front section (1) is not greater than 2.5-times the length of the penetrating section (2) and/or the ratio of the length of the front section (1) to the diameter or the width across corners of the penetrating section (2) is not greater than 2.2 (FIG. 7).

23 Claims, 10 Drawing Sheets

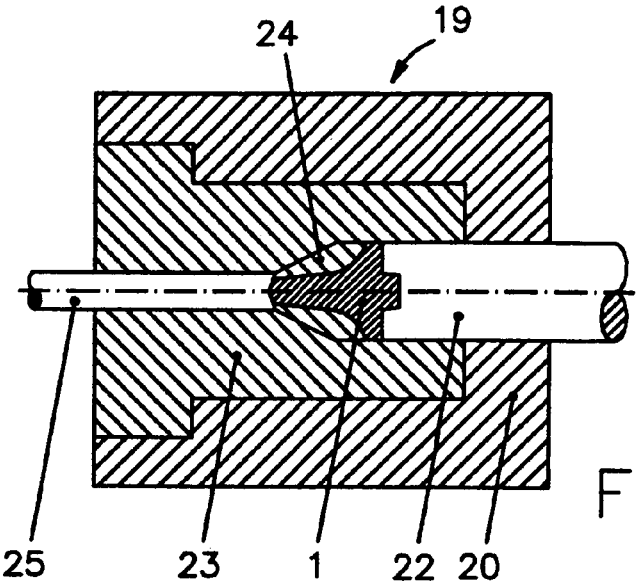
Fig.9
Fig.10
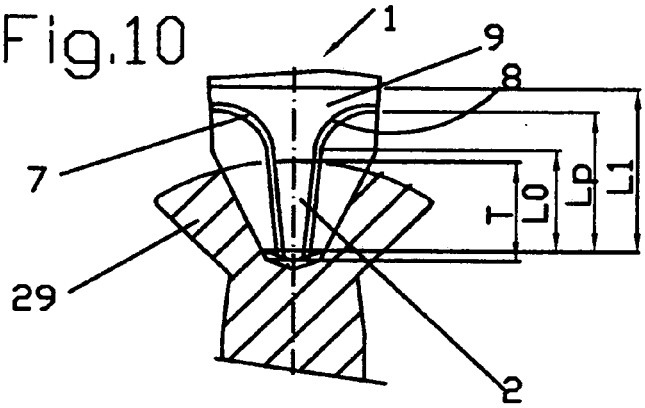
Fig.11
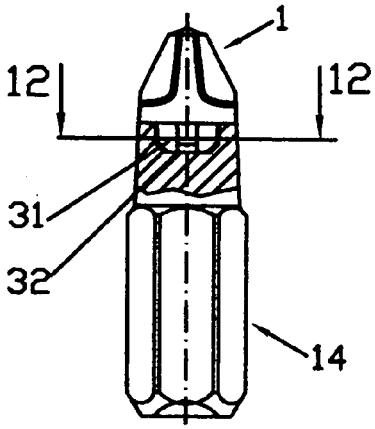
Fig.12
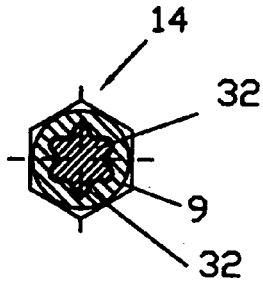

SCREWDRIVER BITS

RELATED APPLICATION

This application is a continuation of application Ser. No. 09/992,900, filed Nov. 6, 2001 now abandoned, which is a continuation-in-part of application PCT/DE01/00852, filed Mar. 6, 2001, which designates the United States of America. The entire contents of PCT/DE01/00852 are hereby incorporated by reference in their entireties.

FIELD OF THE INVENTION

The invention pertains to a screwdriver bit, particularly a screwdriver bit for use with power screwdrivers.

BACKGROUND OF THE INVENTION

Screwdriver bits of this type have thus far been manufactured from alloyed tool steels that usually contain carbon and alloying additions, such as silicon, manganese, chrome, molybdenum and vanadium, in fractions of less than 1%. After hardening and tempering, these steels have a hardness of approximately 60–64 HRC. When used with power screwdrivers, the tips of the screwdriver bits manufactured from tool steel suffer from relatively high wear because they are subjected to higher stress than those of manual screwdrivers. It is desirable to extend the service life of screwdriver bits used in commercial applications, particularly those used in the installation of screws on automated production lines.

The manufacture of cross-tip screwdriver bits from metal-powder mixtures, i.e., from hard metals, has been attempted (DE 92 11 907 U1, DE 42 41 005 A1 and DE 43 00 446 A1). Here, the screwdriver bit blanks were manufactured by means of injection molding where flux was added to the hard metal powder. The flux was extracted from the injection-molded blanks during a subsequent process, and the blanks were then sintered to the final shape and density at a high temperature. Although screwdriver bits of hard metal have greater hardness than those of high-speed steel, they are so brittle that they fracture at torques lower than those commonly encountered in practice.

The design of pressing tools for manufacturing screwdriver bits of hard metal is described in VDI-Zeitschrift No. 7–9 (1999), pp. 42–45. Here, the blanks are directly pressed from metal powder. The above-mentioned article reported that crack-free, dimensionally stable screwdriver bit blanks can be manufactured by employing the described design of the pressing tools and the filling process with the aid of the finite-element method. However, neither the actual load values of the screwdriver bits that are mass-produced with this method nor whether these bits can meet the values required in practice is known. Screwdriver bits of this type have not been introduced to the market.

In contrast to the one-piece screwdriver bits discussed thus far, a screwdriver for cross-recess screws which consists of a shaft of relatively soft steel and a tip section of extremely hard material is described in U.S. Pat. No. 3,393,722. The bottom surface of the hard-metal tip section contains a pin that engages into a hole on the end surface of the shaft. The two parts are connected together by means of welding. The disadvantage of this design is that the connection between the tip section and the shaft by means of the cylindrical projection does not allow the transmission of torques from the shaft to the tip section unless the two parts are welded or soldered together. The tip section preferably consists of hard metal (tungsten carbide). The cross-tip profile of the tip section is relatively long, e.g., as long as those manufactured by conventional manufacturing methods, in which the cross-tip profile is produced by machining the grooves. However, such a long cross-tip profile is disadvantageous for hard-metal tip sections because hard metal is more brittle than steel and the long profile is unable to withstand high torques. In addition, this long profile is disadvantageous with respect to the manufacture of the tip section described further below. Screwdrivers or screwdriver bits of this design have not been introduced to the market, although the corresponding application was submitted more than 30 years ago and the demand for wear-resistant screwdrivers or screwdriver bits continues to increase. This also applies to a tool disclosed in DE 70 44 913 U1 in which a tip section of a high-strength material is connected to a shaft section of a material of lesser quality. Blanks of the tip section are preformed by means of a powder-metallurgical method. However, neither of these two documents contains any indications regarding the manufacturing method, the shaping, or the dimensions. Consequently, it can be assumed that no manufacturing methods that provided satisfactory results were found for these designs.

FR 2 469 250 discloses a cross-tip for a screwdriver which is manufactured from metal powder by means of pressing and subsequent sintering. The cross-tip profile of the penetrating section rises from a plane that extends perpendicular to the longitudinal axis of the tip body without a readily recognizable transition in the form of a radius or chamfer. On its rear side, the tip body contains a prismatic incision for producing the connection with the corresponding end of the screwdriver (shaft), wherein said connection should be realized by means of brazing. The length of the cruciform lands should approximately correspond to half the length of the tip body. In this case, steel or hard metal powder is used as the starting material.

In such a design, it is disadvantageous that the cruciform lands make the transition into the base plane without a radius or chamfer. Such sharp and abrupt transitions cause stress concentrations, in particular, with hard materials such as hard metal, where said stress concentrations significantly reduce the load bearing ability at this location, particularly torsional loads.

Another disadvantage can be seen in the described fastening method.

A self-centering of the two parts to be connected is not achieved with a continuous transversely extending incision. This self-centering can only be achieved with an auxiliary device, e.g., a ring that is stationarily placed onto the connecting point and cannot shift, not even during brazing.

Based on this state of the art, the invention aims to manufacture screwdriver bits of hard metal in such a way that the torques required in practical applications can be transmitted in the region of the penetrating sections due to the superior hardness, and that a significantly higher wear-resistance or a significantly longer service life is achieved than with conventional designs of this type, where the invention should also allow an inexpensive manufacture of the screwdriver bits.

SUMMARY OF THE INVENTION

These objectives are attained by the present invention.

During tests and investigations that led to the novel screwdriver bits according to the invention, it was determined that it is practical to manufacture two-piece screwdriver bits with a very short front section of hard metal and a drive section of steel rather than one-piece screwdriver bits as is proposed, for example, in DE 92 11 907 U1, DE 42 41 005 A1, and DE 43 00 446 A1. According to the invention, this is achieved by realizing the front section of hard metal with a total length that is essentially defined by the length of the penetrating section, the dimensions of which are based on the maximum penetration depth of the interior profile of screw heads of the corresponding screw size and/or type. The length of a base section and the length of an anchoring section that connects the front section to the drive section of the screwdriver bit are added to this relatively short length.

The invention provides two significant advantages. First, a uniform, precise and superior densification is achieved during the pressing of the blanks such that the region of the penetrating section of the front section has superior resistance to bending moments acting on the cruciform lands during the transmission of torque. A suitable grain size composition of the chosen metal powder mixture can also contribute to this stability. Such a uniform and superior densification was very difficult to achieve until now, in particular, when producing cross-tips, because the compression mold is filled with metal powder to a similar height as that required for manufacturing one-piece screwdriver bits. The pressure exerted on the metal powder filling by the ram does not have a uniform effect that extends up into the region of the tip and the grooves between the lands because this pressure diminishes within the filling due to the friction of the filling on the walls of the mold. Second, the invention ensures that the blanks reach the sintering process without cracks as is required, in particular, for the superior durability of cross-tips. The metal powder that is compressed in the mold under high pressure, and the blank produced thereby, has high resistance to its removal from the mold. This resistance increases proportionally with the surface area of the blank. The resistance to the removal from the mold must be overcome with the force of the ejector pin or bottom die which acts on the central tip. The high specific load on the tip and the ejector force which acts on the cruciform lands may lead to the formation of fine cracks that cannot be remedied during the sintering process and interfere with the homogeneity of the structure. The short design of the hard metal front section in accordance with the invention significantly reduces the required ejector force. Consequently, it is possible, e.g., to eliminate the requirement for a complicated and expensive compression mold in which the bottom die has not only the profile of the central tip but also the profile of the backs of the cruciform lands which conically extend toward the tip, e.g., as is the case in the previously described method [VDI-Zeitschrift No. 7–9 (1999), pp. 42–45].

According to another characteristic of the invention, the anchoring elements for connecting the front section to the shaft section are realized such that a solid connection suitable for transmitting torques is achieved solely by pressing the two anchoring elements together, if so required, with the aid of an adhesive.

Other advantageous characteristics of the invention are disclosed herein.

BRIEF DESCRIPTION OF THE FIGURES

Embodiments of the invention are described in greater detail below with reference to the enclosed drawings. The drawings show:

FIGS. 8 and 9 are highly schematized representations of a pressing tool for manufacturing the front section according to the invention shown in FIG. 4.

FIG. 10 is an enlarged side view of the front section according to FIG. 4 in combination with the corresponding screw head that is illustrated in sectioned form.

FIG. 11 is a feature of a second embodiment of a screwdriver bit according to the invention which corresponds to FIG. 7.

FIG. 12 is a cross-sectional view taken along line 12—12 in FIG. 11.

DETAILED DESCRIPTION OF EMBODIMENTS OF THE INVENTION

Figure 1:
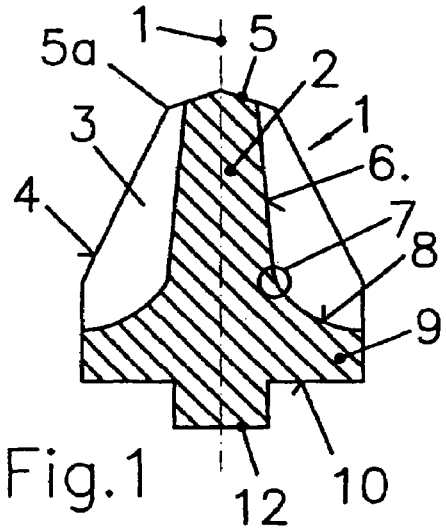
FIGS. 1–3 are schematic longitudinal sections through three different sizes of front sections of a screwdriver bit according to the invention for cross-head screws, where the cruciform lands are not illustrated in sectioned form.

FIG. 1 shows a front section 1 of a screwdriver bit according to the invention. On its front end, the front section 1 is provided with a penetrating section 2 in the form of a conventional cross-tip that serves for penetrating into the corresponding interior profile of a cross-head screw. The cross-tip contains four ribs or lands 3 that are arranged in cruciform fashion and have upper edges 4 that conically converge toward the front and end at a flattened end section 5 that is insignificant for the purpose of the invention. Cruciform flutes or grooves with groove bottoms 6 that also extend conically up to the end section 5 are arranged between the lands 3, where said groove bottoms are curved or beveled radially outwardly on the side that faces away from the end section 5 beginning at a point 7 that defines the rear end of the penetrating section 2, such that the groove bottoms form a section referred to as the continuation 8 below.

A base section 9 that, for example, is realized cylindrically and ends at a rear end surface 10 that usually extends perpendicular to a central axis or axis of rotation 11 of the front section is located adjacent to the rear of the continuation 8. An anchoring section 12 in the form of a pin protrudes rearwardly from the end surface 10, where the anchoring section has a reduced cross section in comparison to the base section 9, and where the penetrating section 2, the base section 9 and the anchoring section 12 are arranged coaxially to the axis 11. This basic shape of the front section 1 is essentially identical in all screwdriver bits according to the invention, where the outer contours and the dimensions of, in particular, the sections 2, 4 and 6 must be adapted to the interior profile of the corresponding screw, and where the section 12 must be adapted to the given anchoring system as described below.

Figure 2:
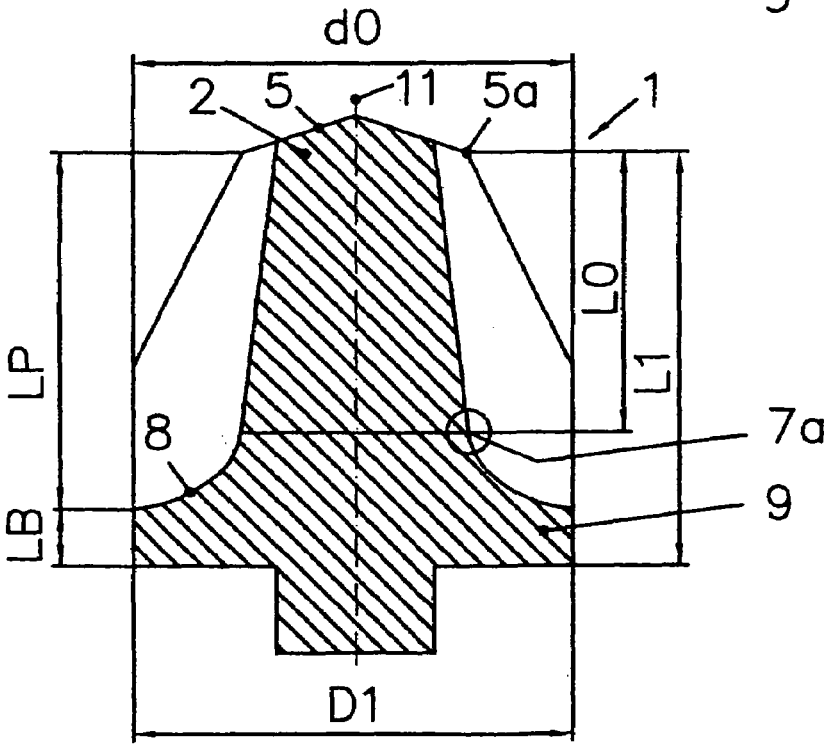

FIG. 2 shows a front section 1 that is realized similarly to FIG. 1, as well as the dimensions that are important for the invention. According to this figure, L0 denotes the length of the penetrating section 2 between the beginning 5*a* of the end section 5 and the beginning points 7, 7*a* of the continuation 8, L1 the length of the front section 1 between the beginning 5*a* of the end section 5 and the end surface 10, LP the profile length that results from the sum of the length L0 and the length of the continuation 8, and LB the length of the base section 9 such that LP+LB=L1. Here, all lengths are measured in the direction of the longitudinal axis 11 (FIG. 2). In addition, a comparison of FIGS. 1–3, in which identical components are designated by the same reference symbols, indicates that the respective points 7, 7*a* and 7*b*, at which the conical regions of the groove bottoms 6 of the penetrating section 2 end and transform into the continuation 8, lie at the same elevation as the lower ends of the upper edges 4 of the lands 3 in FIG. 1. However, the corresponding points 7*a* and 7*b* lie below the lower end of the upper edges 4 in FIG. 2 and above said lower ends of the upper edges in FIG. 3, since the dimension D1 that defines the diameter of the front section 1 at the end of the length L1, i.e., in the region of the base section 9 and the end surface 10, as well as the cone angle formed by the upper edges 4 of the lands 3 and the groove bottoms 6, is usually specified by standards or the like. The upper edges 4 consequently end toward the rear at the locations at which they intersect an imaginary cylindrical circumference of the base section 9. In addition, d0 denotes the diameter at the end of the length L0, i.e., at the points 7, 7*a* and 7*b*.

Figure 4:
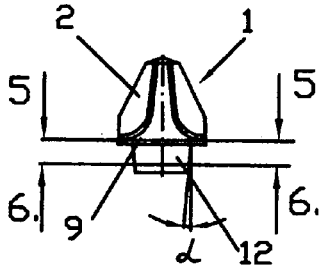
FIG. 4 is a schematic side view of a front section according to the invention which is realized similarly to FIGS. 1–3.
Figure 5:
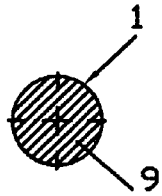
FIGS. 5 and 6 are cross-sectional views taken along lines 5—5 and 6—6 in FIG. 4.
Figure 6:
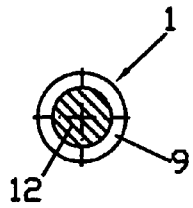
Figure 7:
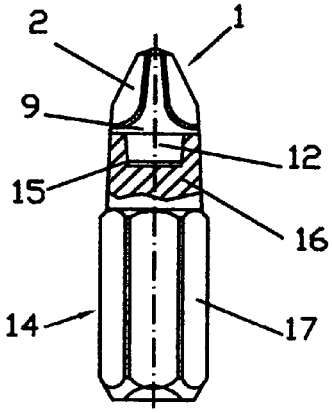
FIG. 7 is a partially sectioned side view of a screwdriver bit according to the invention with a front section according to FIGS. 4–6.

According to the invention, a screwdriver bit is assembled from the separately manufactured front section 1 (FIGS. 4–6) and the also separately manufactured drive section 14 (FIG. 7), which, for example, is fixed in the chuck of a power screwdriver. In this case, the front section 1 is manufactured from a hard metal, and the drive section 14 is manufactured from a conventional tool steel used for this purpose. In order to coaxially connect the two parts 1, 14 to a screwdriver bit (FIG. 7), the drive section 14 is provided with a recess 15 on its end surface that faces the front section 1, where said recess is machined into the surface of the drive section and its inside cross section is adapted to the outside cross section of the anchoring element 12. The connection is produced by inserting the anchoring section 12 into the recess 15 and fixing the anchoring part therein by means of pressing, soldering or the like, such that the drive section 14 is able to transmit the required torques to the front section 1. FIG. 7 shows that the recess 15 may be arranged, for example, in a cylindrical or slightly conical transition section 16 that is situated adjacent to a section 17 of the drive section 14 which has a conventional hexagonal outside profile and produces a flush transition between the section 17 and the base section 9.

Figure 8:
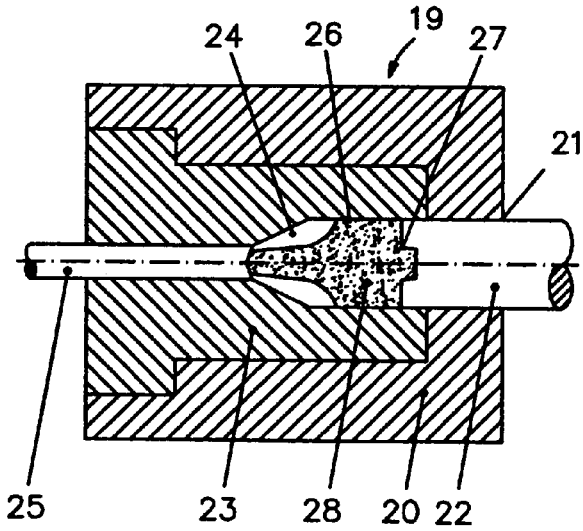

The front section 1 is manufactured with the aid of a pressing tool 19, which is schematically illustrated in FIGS. 8 and 9. This pressing tool contains a press bushing 20 that is provided with, for example, a cylindrical receptacle opening 21 for a cylindrical ram 22 on one end and an inserted compression mold 23 on the other, where the compression mold is realized in the form of a negative mold 24 for the front section 1 to be produced on the side located coaxially opposite to the receptacle opening 21, i.e., the compression mold is realized in the form of a negative mold for a cross-tip in the embodiment shown. The press bushing 20 contains a cavity 26 between the negative mold 24 and the receptacle opening 21. The compression mold 23 is also provided with a central passage, into which an ejector 25 is inserted. On its end surface that faces the compression mold 23, the ram 22 is provided with a recess 27 that is realized in the form of a negative mold for the anchoring section 12.

When manufacturing the front section 1, the cavity 26 is initially filled with the desired hard metal powder as indicated by reference symbol 28 in FIG. 8, i.e., while the ejector 25 is inserted and pushed forward up to the compression mold 24. The ram 22 is then inserted into the receptacle opening 21 and pressed in the direction of the compression mold 23 with the pressure required for compacting the hard metal powder 28 such that the hard metal powder 28 is compacted and assumes the shape of the front section 2 (FIG. 9). The ram 22 is then removed and the ejector 25 pushed forward in order to eject the front section 2 from the compression mold 22 and the press bushing 20. The front section 2 obtained thereby is sintered at conventional temperatures for this type of compression molding process, e.g., at 1100° C.–1200° C. The hard metal powder mixture contains, for example, cobalt, molybdenum and tungsten carbide and, if applicable, fractions of iron such that the compressing and sintering processes result in an extremely hard and wear-resistant front section 1.

The two-piece design of the screwdriver bits 2, 14 according to the invention makes it possible to manufacture the functional or effective zone of the front section 1 by means of a comparatively simple and inexpensive method in which optimal compression conditions are achieved. After connecting the front section 1 to the drive section 14, a screwdriver bit is obtained that is able to withstand high loads.

Figure 3:
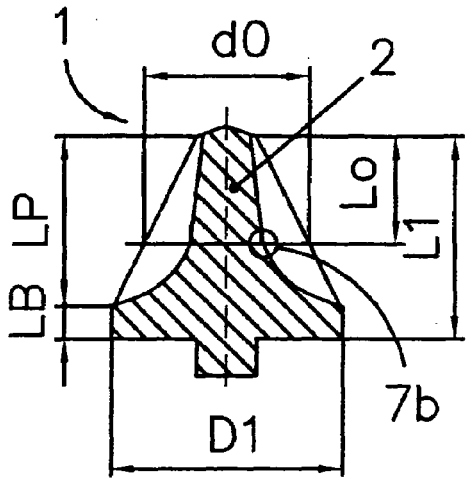

In order to achieve a uniform pressure distribution and thus a homogenous structure of the front section 1, it is required, according to the invention, to realize the front section 1 as small as possible in order to produce the least possible friction losses in the tool 19. Since the shape and size of the penetrating section 2 depend on the head profile of the corresponding screw, this short front section is realized based on the following considerations:

It should initially be clarified that the previously described sections and sizes of the screwdriver bits according to the invention not only apply to the cross-tip system according to FIGS. 1–3, but also to other bit/screw pairings as described below. This includes, for example, the crosshead systems according to Phillips and Pozidrive, conventional hex-head systems, polygonal, multipoint or undulated systems according to TORX® or square systems according to Robertson, as well as various special systems, e.g., Tri-Wing and Torque-Set.

DIN/ISO standards or other standards and regulations that, for example, were stipulated by the original developers of the respective profile systems apply to the dimensions of the penetrating sections 2 of the bits and the corresponding interior profiles of the screws.

As deemed necessary for the adequate operation and bit/screw pairing, these standards and regulations were incorporated for the purpose of the invention. Thus, the cross-tip systems are based on DIN standards 967, 7996 and 7997 and/or EN-ISO 7045-7047, according to which the screws of different thread diameters are categorized into cross-tip Nos. 0–4. In addition, screws with different heads and interior profiles and consequently different penetrating depths may be assigned to each screw.

With respect to a superior fit of the cross-tip in the interior profile of the screw, it is important that the cross-tip be in surface contact with the flanks of the interior profile of the screw with the flanks of its lands 3 (FIG. 1). The profile of the cross-tip must be long enough to penetrate into the cross-recessed profile of the screws in such a way that the continuation 8 of the cross-tip which no longer corresponds to the correct contour of the penetrating section 2 is not situated on the edge of the cross-recessed profile of the screw. This is schematically indicated in FIG. 10 that shows a front section 1 according to FIGS. 1–7 which penetrates into the profiled opening of a screw head 29 with a penetrating depth T that is smaller than the length L0 of the penetrating section 2. The point 7, at which the cruciform groove bottoms 6 transform into the continuation 8, is situated sufficiently far outside the screw head opening in this case. If L0<T were to apply, the penetrating section 2 would only be partially situated in the screw head opening because the continuation 8 would be seated on the screw head 29. This would also cause the superior surface area contact between the penetrating section 2 and the corresponding surfaces of the screw head opening to be lost, wherein the bit would be seated in the screw with slight play, which is disadvantageous for the transmission of high torques. If L0=T, an instance in which L0<T could also occur depending on the respective tolerances.

Naturally, this determination is based on the fact that the profile dimensions of the penetrating sections correspond to the respective standards assigned to the type and size of the given cross-head screw within the intended penetrating section of the screw.

In order to arrive at a suitable compromise for practical applications, the length L0 is determined on the basis of the screw head of a screw series assigned to the profile size of the penetrating section, which, according to the respective standards or other regulation, has the greatest penetrating depth T. For this purpose, it is initially determined which screw type has the head shape that results in the greatest penetrating depth T. In case of cross-head screws, these are, for example, fillister-head screws according to EN-ISO 7047. Since the penetrating depth T is significantly less in all other types of screws, bits with dimensions that are based on fillister-head screws also fit heads of other screws with the same interior profile.

If screws with a certain size of the cross-recessed profile have different head shapes that result in different penetrating depths T, the screw with the greatest penetrating depth T is used for determining the dimension of L0.

This is explained below with reference to one concrete embodiment.

According to EN-ISO 7045-7047 (Type Z, Pozidrive), No. 2 fillister-head screws with a cross-recessed profile may, for example, have different standardized penetrating depths. The standardized range of the penetrating depth lies between $T_{MIN}$=1.48/1.93 mm and $T_{MAX}$=2.9/3.35 mm in this case. According to the invention, the broadest occurring range of the largest shape of screw head is used for determining the dimension of L0, which means that 3.35 mm is assigned to L0. This ensures that the front section 1 is able to penetrate into all screw heads with the full penetrating depth T. One advantage of this method for determining the dimension of L0 can be seen in the fact that L0 is not increased beyond the value required for achieving the desired function.

According to the invention, it is required that the dimension L1 be selected to be as small as possible in order to ensure a uniform pressure distribution during the compression process. According to the invention, this is ensured by selecting L1 to be smaller than 2.5×L0, preferably less than 2.2×L0, in particular, less than 2.0×L0. In the previously described embodiment, this corresponds to L1=8.5 mm and 7.48 mm and 6.80 mm, respectively. In this case, the dimension L1 in a cross-recessed profile depends upon, among other things, how large the dimensions of LP and LB (FIG. 2) should be. It is also quite obvious that the minimum dimension of L1 is the respective dimension of L0. With respect to LP, it was determined that it is practical to select the continuation 8 to be significantly smaller than in conventional bits. However, if the continuation 8 is selected to be too small, unfavorable compression conditions result during the compression process due to the steep transition from the base section 9 to the penetrating section 2. On the other hand, if LP is too large, the total length L1 would be too long. Generally speaking, a short profile length LP, in particular, in cross-tips, implies a significant reduction in the total surface area. This significantly reduces the friction during the ejection of the pressed part from the mold, with the short profile length LP also increasing the load bearing ability. Favorable LP/L0 ratios lie between approximately 1.25 and 1.55. In the above-mentioned instance, a dimension of LP between approximately 5.00 and 5.25 mm proved to be practical. In connection with a sufficiently large dimension of L1=6.00–6.25 mm, i.e., L1=1.76×L0 to 1.84×L0, this results in a short front section 1 that consequently can be easily compressed.

The dimensions indicated below proved practical for the three other sizes, Nos. 1, 3 and 4, according to EN-ISO 7045-7047 (Type Z, Pozidrive):

No. 1: the range lies between $T_{MIN}$=1.22 mm and $T_{MAX}$=1.47 mm.

No. 3: the range lies between $T_{MIN}$=2.73 mm and $T_{MAX}$=3.18 mm.

No. 4: the range lies between $T_{MIN}$=3.87 mm and $T_{MAX}$=4.32 mm.

The above-cited dimensions indicate that none of the dimensions of L1 is greater than 2×L0, and that very small dimensions of L1 can be achieved, in particular, for the smaller sizes, even if L1 has a dimension of 2.5×L0. Particularly preferred dimensional ratios for front sections are as follows:

Type: H/Z with continuation P

Nos.: 1–4 $L_1/L_0$ between 1.56 and 1.85

$L_1/L_0$ between 0.9 and 1.15

$L_P/L_0$ between 1.25 and 1.55

It is possible to proceed accordingly with other screw heads [e.g., Type H (Phillips) according to EN/ISO 7045-7047].

In order to increase the durability of the penetrating section further, it may be practical if the length L0 is not chosen in accordance with the greatest penetrating depth $T_{MAX}$ occurring in a screw and the corresponding screw head size assigned to the profile size of the penetrating section, but rather based on a correspondingly smaller dimension $T_{MAX}$ for the smaller screw heads that are assigned to the same profile size.

As described above, a $T_{MAX}$ of 2.9–3.35 mm is stipulated in EN-ISO 7047 for No. Z2 cross-head screws of different size. For applications in which the screwdriver bit is subjected to particularly high loads, it is possible to manufacture front sections with an L0 that is chosen in accordance with the largest screw according to EN-ISO or corresponding standards for smaller screws. With respect to the screw size M5 EN-ISO 7046-2, this would result, for example, in $T_{MAX}$=2.72 mm for the smaller No. Z2 screws. The resulting shorter lengths of L0 or LP and L1 lead to additional improvements in the compression conditions, as well as in the durability of the tip.

Another option for improving the compression conditions and the durability consists of reducing the tip of cross-tip screwdrivers by up to approximately 10%. This shortening of the tip is possible because this region only contributes very little to the transmission of torque due to the small contact surface between the profile of the tip and the inner surface of the cross-recess, as well as the short lever arm effective at this location.

The base section 9 consists of a short, plate-shaped section that primarily serves for integrally forming the anchoring element 12 thereon. The anchoring element may consist of convex elements that protrude from the end surface 10 (FIG. 1) or of concave elements that are countersunk into the end surface 10. A few embodiments are described in greater detail below with reference to FIGS. 11–24, where the front sections 1 essentially correspond to the front section 1 according to FIGS. 1–9 except for occasionally different base sections. Analogously, the drive sections 14 essentially correspond to the drive section 14 according to FIG. 7, which is the reason only different components are identified by different reference symbols than those used thus far. In FIGS. 1–7 that show the basic shape of the front section, the anchoring element has a round cross section, where the pin 12 extends conically from the end surface of the base section 9 to its end, i.e., at an angle a that results in a self-locking connection between the pin 12 and the recess 15 when the two parts are pressed together. The front section according to FIGS. 11 and 12, in contrast, has an anchoring element 31 with a star-shaped profile which is inserted into a recess 32 of the drive section 14 which has a corresponding interior profile. The rigid connection between the two parts 1, 14 is produced, e.g., by means of bonding, soldering, pressing or the like, where the noncircular cross section of the anchoring elements 31, 32 provides the advantage that a coupling without rotational play, which allows the transmission of high torques, is produced due to this positive connection.

Figure 13:
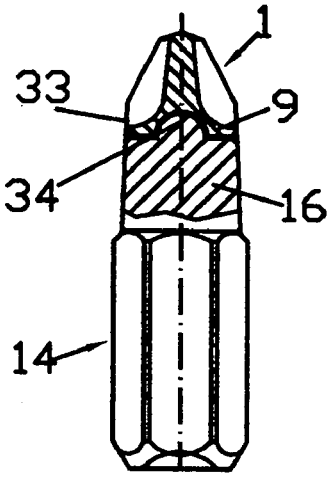
FIGS. 13–16 are front views of three other embodiments of the connection between the front section of hard metal and the drive section which are illustrated in a partially sectioned and non-sectioned form.

FIG. 13 shows a concave anchoring element 33 in the base section 9 and a corresponding anchoring element 34 in the drive section 14, which, however, is realized convexly. In this case, the connection is produced, for example, by means of bonding or soldering.

Figure 14:
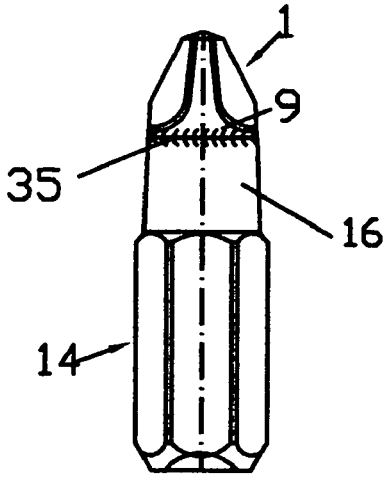
Figure 15:
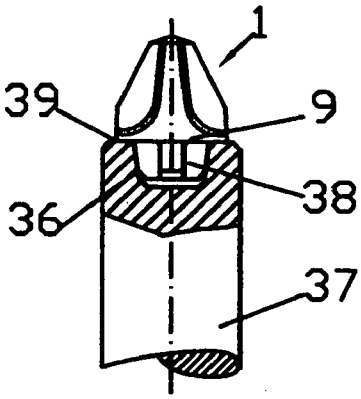
Figure 16:
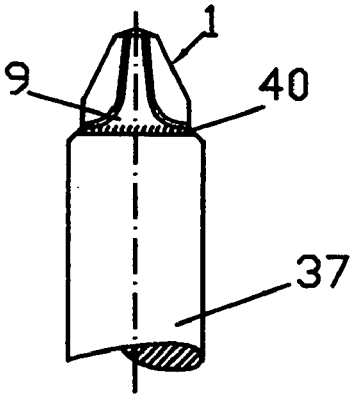

FIG. 14 and FIG. 16 show two variations in which the front section and the shaft section are welded together along the circumference of the connecting point, wherein a centered connection is produced due to a pin on the front section and a corresponding recess on the shaft section.

Figure 17:
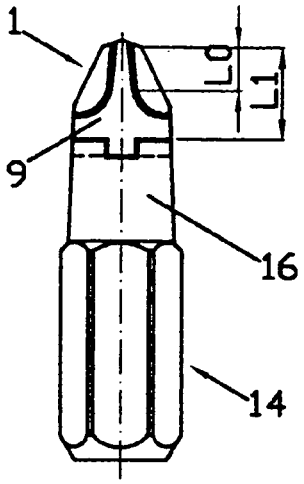
FIGS. 17–19 are screwdriver bits for cross-head screws of various size.
Figure 18:
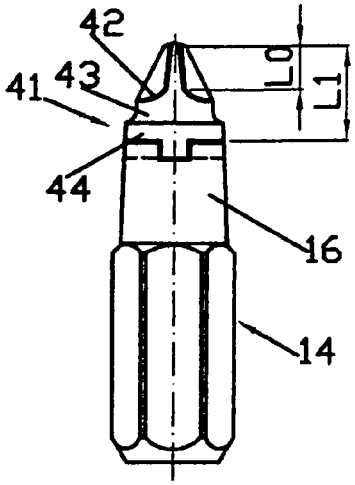
Figure 19:
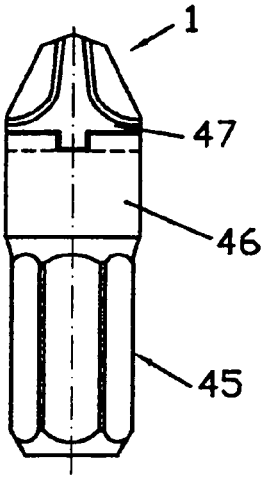

FIGS. 17 and 18 show a direct comparison between two screwdriver bits according to the invention which differ in the region of their base sections 9 and 41, respectively. The base section 9 in FIG. 17 is realized similarly to FIGS. 1–9, with the base section 41 containing a radially widened zone 43 directly adjacent to the continuation 42. This radially widened zone finally transforms into a zone 44 that corresponds to the base section 9. The embodiment according to FIG. 19 which is illustrated in the form of a direct comparison with FIGS. 17 and 18 differs from the embodiment according to FIGS. 7–14 due to the fact that the drive section 45 is connected to the base section 47 of the front section 48 by means of a transition section 46. Here, the base section 47 has a dimension D1 (FIG. 2), which, in contrast to FIG. 7, is larger than the diameter of the hexagonal section of the drive section 45. In this case, the transition section 46 serves for connecting the smaller cross section of the hexagonal section to the greater cross section of the base section 47. In this embodiment example, the anchoring element is realized as described with reference to FIGS. 22–24.

Figure 20:
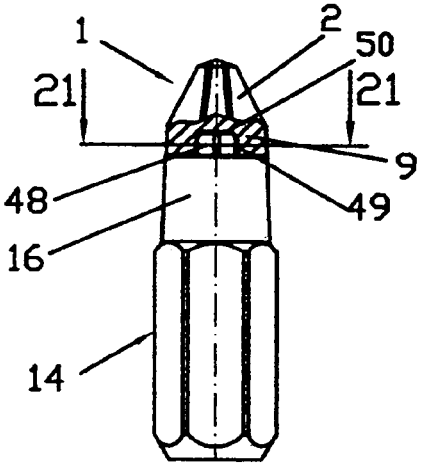
FIG. 20 is an embodiment of a screwdriver bit according to the invention which corresponds to FIG. 7, but with an anchoring element that convexly protrudes from the drive section.
Figure 21:
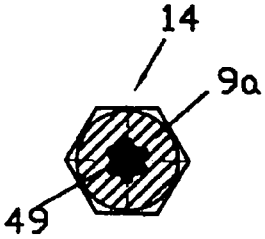
FIG. 21 is a cross-sectional view taken along line 21—21 in FIG. 20.

FIGS. 20 and 21 show an anchoring element 48 that protrudes from the upper end surface of the drive section 14 and is inserted into a corresponding anchoring element 49 realized in the form of a recess and formed or molded into the end surface of the base section 9 when pressing the front section 1.

According to FIG. 21, the anchoring elements 48 and 49 have a star-shaped profile that is realized similarly to FIG.

12. The two anchoring elements 48, 49 are connected, for example, by means of soldering along a solder joint 50.

Figure 22:
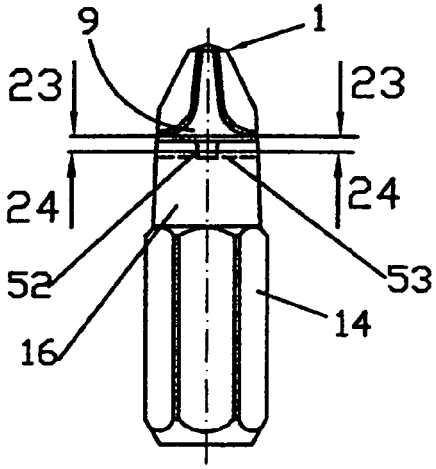
FIG. 22 is a screwdriver bit for cross-head screws which corresponds to FIG. 17, but with another embodiment of the anchoring element.
Figure 23:
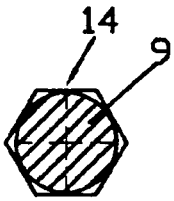
FIG. 23 is a cross-sectional view taken along line 23—23 in FIG. 22.
Figure 24:
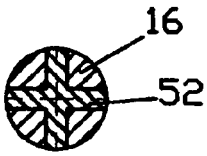
FIG. 24 is a cross-sectional view taken along line 24—24 in FIG. 22.

According to FIGS. 22–24, a protruding anchoring element 52 with a cruciform profile is integrally formed onto the base section 9 of the front section 1, where said anchoring element is inserted into a corresponding anchoring element 53 that is realized in the form of a cruciform recess formed in the upper end surface of the transition section 16 of the drive section 14. The connection is produced, for example, by means of bonding or soldering. This embodiment is currently considered the most favorable variant of an anchoring element.

Figure 25:
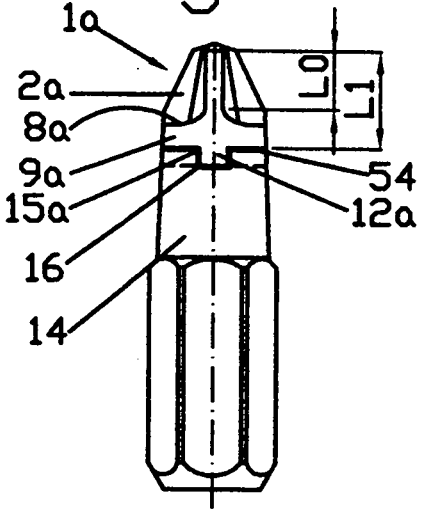
FIG. 25 is an embodiment that is realized similarly to FIG. 22, but with a front section for Pozidrive screws (PS).

FIG. 25 shows an embodiment similar to FIG. 17, where a front section 1*a* with a penetrating section 2*a* is provided with a Pozidrive profile that is realized as shown in FIGS. 22–24. The base section 9*a* is provided with a protruding anchoring element 12*a* that extends into a corresponding anchoring element 15*a* in the form of a recess that is machined into the upper end surface of the transition section 16 of the drive section 14. The two anchoring elements 12*a*, 15*a* are connected together by means of soldering in the region of the contact surfaces.

In other respects, the previous explanations regarding the other cross-tip bits (PH) according to Phillips apply to the Pozidrive (PZ) bits of FIG. 25. FIG. 25 indicates that L0 is the length of the penetrating section 2*a* that extends up to the continuation 8*a*, where L1 is the total length of the front section 1*a* except for the length of the anchoring element 12*a*. The previous explanations regarding the Phillips bits also apply to the dimensions L0 and L1 of the Pozidrive bits, i.e., L1#2.5×L0, preferably L1#2.2×L0, in particular, L1<2×L0, where L0 is determined analogously to the previous description.

If only a single penetrating depth range $T_{MIN}$ to $T_{MAX}$ is predetermined or stipulated for a screw size or a screw head shape, L0 may also be chosen as the dimension $T_{MAX}$ plus a small allowance for compensating tolerances because the length L0 would always be appropriate in this case.

In other respects, it is quite obvious that the length of the anchoring element, as measured in the direction of the axis 11 (FIG. 2), should be as small as possible so as not to obstruct the homogenous pressure distribution during the compression process. However, since the anchoring elements are arranged on the side of the front sections 1, 1*a* which faces the ram, their length is less critical than the lengths L0 and L1. Nevertheless, the anchoring elements, if so required, may be incorporated into the dimension L1.

Figure 26:
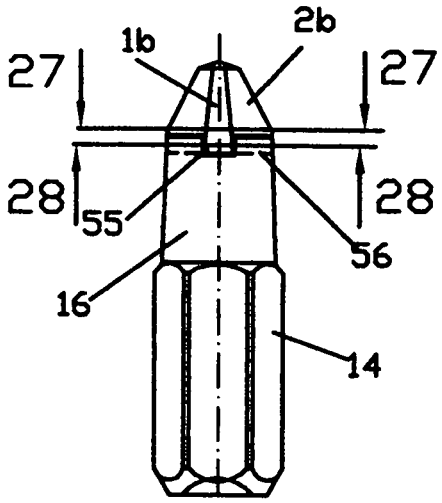
FIGS. 26–28 are features of another screwdriver bit for cross-head screws which correspond to FIGS. 22–24.
Figure 27:
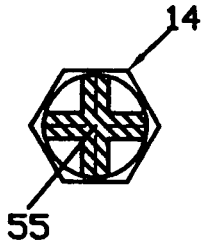
Figure 28:
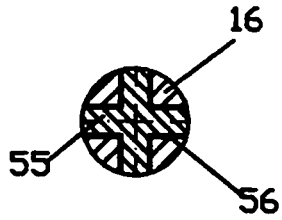

FIGS. 26–28 show an embodiment of a screwdriver bit for cross-head screws, in which a front section 1*b* of hard metal contains no base section and no anchoring section. The cruciform lands continue to extend cylindrically beginning at the length L0, wherein the wall thickness, the core and the diameter of a cruciform land profile 55 have the same value as at the location L0. The cruciform land profile 55, which in this case is the anchoring element, is positively inserted into a corresponding recess 56 in the end surface of the drive section 14 and is preferably connected to it by means of soldering.

The previous explanations regarding screwdriver bits with cross-tip profiles correspondingly apply to screwdriver bits with other profiles, e.g., hex-head screws, TORX® screws and Robertson screws. In these screwdriver bits, the penetrating sections have a uniformly—with Robertson screws a slightly conically—extending profile when viewed in an axial cross section. Here, the profile preferably transforms into a base section in the form of a rounded continuation. This provides the advantage that the cross section of the hard metal tip (of the hard metal functional part) is reinforced in the region in which the torsional load acts when using the screwdriver. The anchoring in the drive section is realized similarly to the previous description.

In TORX® screws, the minimum lengths L0 of the penetrating sections are also stipulated by the manufacturer's standards or other regulations, which are available, e.g., from the corresponding data sheet. The functional lengths for the different profile sizes also can be derived from it, if so required, with an extra tolerance. One proceeds similarly with other profile types, e.g., hex-head profiles or Robertson profiles. In this case, the penetrating sections with or without continuation may transform into a base section in accordance with the continuation 8, 8*a* (e.g., FIGS. 1, 25) that usually extends along a circular arc or into a cone. However, there also exist TORX® profiles, hex-head profiles, multipoint head profiles and Robertson profiles that transform into a base section without such a continuation 8, 8*a*, where the base section is connected to a drive section located coaxially adjacent to the base section by means of anchoring elements similarly to the previous description. In such instances, the length L1 can be considered to be identical to the length LP. This implies that the L1/L0 ratio may be lower than in cross-tip front sections 1, 1*a* that have a comparatively large continuation 8, 8*a* and consequently a comparatively large LP. The utilization of the invention in TORX® profiles and other profiles is described in greater detail below with reference to FIGS. 29–38.

Figure 29:
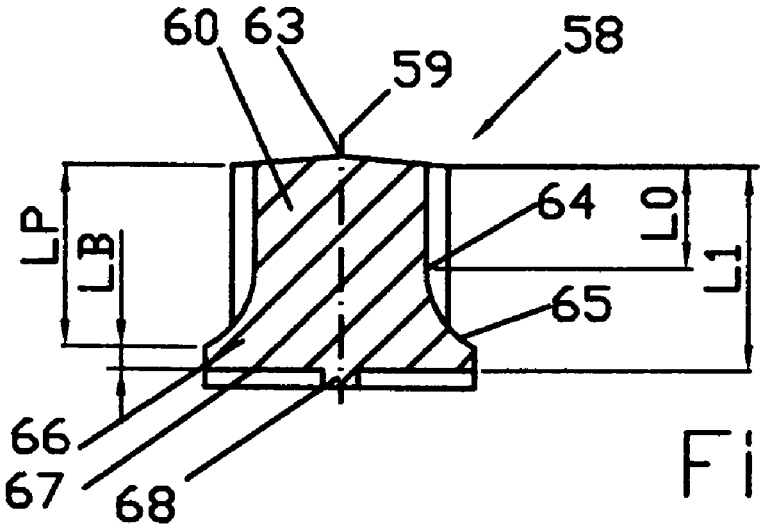
FIG. 29 is a greatly enlarged partial longitudinal section through a front section of a screwdriver bit according to the invention for TORX® screws.
Figure 30:
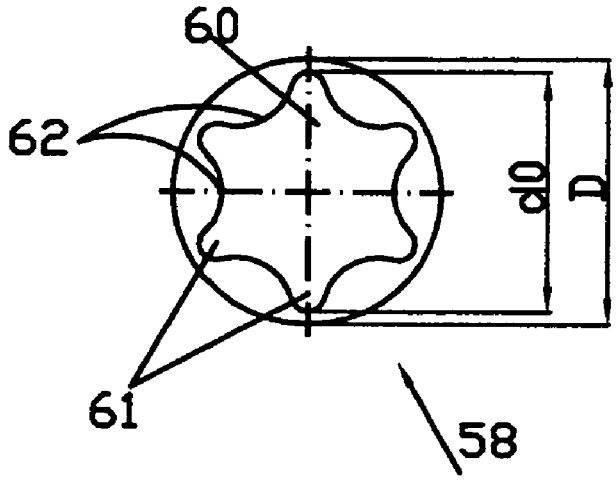
FIG. 30 is a top view (front view) of the screwdriver bit according to FIG. 29.

FIGS. 29 and 30 show a highly enlarged front section 58 of a screwdriver bit according to the invention which is intended for TORX® screws, wherein said front section is illustrated similarly to FIGS. 1 and 2. The front section 58 is arranged coaxial to a longitudinal axis or axis of rotation 59 and provided with a penetrating section 60 on its front end. This penetrating section has a conventional TORX® profile, the undulating progression of which can, in particular, be ascertained from FIG. 30, wherein the penetrating section penetrates into the corresponding interior profile of the TORX® screws. The TORX® profile is characterized by lands 61 and grooves 62 (FIG. 30) with rounded edges, which extend parallel to the axis 59 and are alternately arranged in the circumferential direction such that an undulating progression of the profile along an imaginary circle is achieved. In the entire penetrating section 60, the TORX® profile is the same in the direction of the axis 59, and ends in a conical-insignificant for the purpose of the invention-flattened end section 63. To the rear, away from the end section 63, the groove bottoms curve radially outward beginning at a point 64 that defines the rear end of the penetrating section 60. This means that a continuation 65 is formed similarly to the continuations 8, 8*a*, wherein said continuation ends at a base section 66 that essentially corresponds to the base section 9 in FIG. 1 and has a rear end surface 67 that usually extends perpendicular to the axis 59. An anchoring element 68, realized as described in FIGS. 22–24, projects rearward from the end surface 67.

The basic shape of the front section 58 essentially corresponds to that of the front section 1 in FIG. 1. For the purpose of the present invention, the same lengths L0, L1, LP and LB, as well as the same diameters d0 and D1, as those explicitly described above with reference to FIG. 2 were assigned to this front section.

Figure 31:
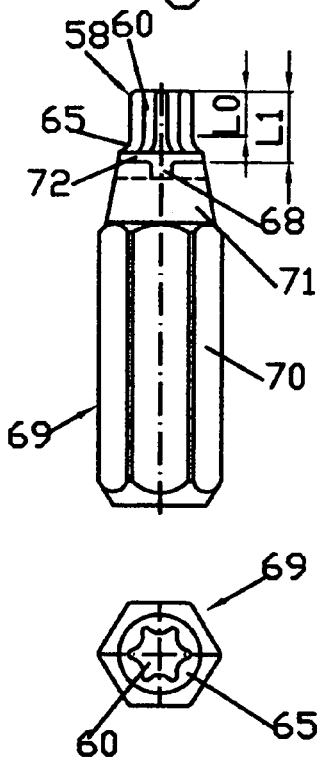
FIG. 31 is a side view and a front view of a screwdriver bit according to the invention for TORX® screws with continuation radius.

According to the invention, a screwdriver bit for TORX® screws according to FIG. 31 is assembled from the separately manufactured one-piece front section 58 and the also separately manufactured drive section 69 that, for example, has a customary hexagonal profile in a section 70, and is connected to the front section 58 by means of a transition section 71 similarly to FIGS. 1–30. For this purpose, the transition section 71 is provided with a corresponding anchoring element 72 in the form of a recess arranged in its front end surface. The two anchoring elements 68, 72 are connected to one another similarly to the previous description, i.e., by means of bonding, welding, soldering or other suitable connecting methods.

The front section 58 is manufactured similarly to the cross-tip front sections 1, namely from a hard metal powder with the aid of the pressing tool according to FIGS. 8 and 9, wherein the press bushing 20 and, if applicable, the compression mold 23 of said pressing tool are correspondingly adapted.

In order to ensure a uniform pressure distribution during the compression process, the dimension L0 is again chosen to be as short as possible, preferably in accordance with the penetrating depth T specified by the manufacturer of the respective TORX® system in a data sheet or the like. In this case, the length L0 is preferably chosen to be at least equal to the specified penetrating depth, wherein an extra tolerance for compensating tolerances is preferably added. Similarly to the cross-tips, the length L1 amounts to no more than L1=2.5×L0, preferably no more than L1=2.2×L0, in particular, L1<2.0×L0. This applies independently of the fact whether the specified (minimum) penetrating depth T or a slightly larger or a slightly smaller dimension is used for L0, because only very short values that are suitable for use in the described compression method result for the front section 58, even if L1=2.5×L0.

In this context, the invention refers, in a purely exemplary fashion, to the TORX® systems of the sizes 15, 20, 30, 40 and 50, for which minimum penetrating depths of 2.16 mm, 2.29 mm, 3.18 mm, 3.30 mm and 4.57 mm are respectively specified by the manufacturer or distributor. These minimum penetrating depths are intended to ensure a sufficiently deep penetration of the TORX® profiles into the screw heads, as well as the transmission of the required torques. According to the invention, the length L0 for these five sizes is, for example, 2.40 mm, 2.50 mm, 3.50 mm, 3.65 mm and 5.05 mm, respectively, and the length L1 for these five sizes is 4.1 mm, 4.8 mm, 5.8 mm, 6.95 mm and 8.35 mm, respectively. In this case, the dimensions of L1 lie significantly below the value corresponding to double the L0 value. Particularly preferred dimensional ratios for front sections are as follows:

Type: TORX® with continuation
Nos.: 10–50 $L_1/L_0$ between 1.65 and 1.9
$L_1/d_0$ between 0.95 and 1.29
$L_P/L_0$ between 1.30 and 1.55
Type: TORX® without continuation
Nos.: 10–50 $L_1$=LG; LG/$L_0$ between 2.0 and 3.0
$L_1$=LG; LG/$d_0$ between 1.25 and 2.2.

With respect to the dimensions LP, LB, d0 and D1, the previous explanations regarding cross-tip bits apply.

Figure 32:
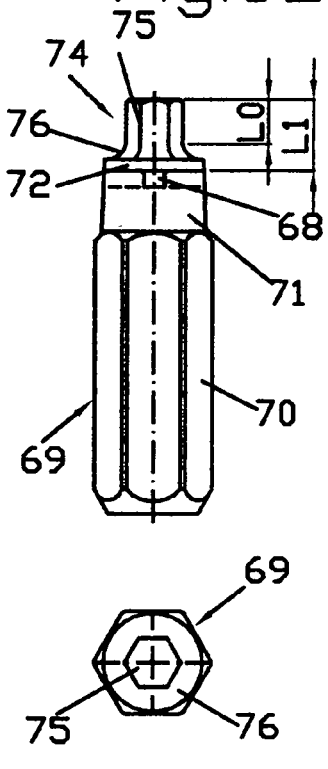
FIG. 32 is a side view and a front view (top view) of a screwdriver bit according to the invention for hex-head screws with continuation radius.

FIG. 32 shows a screwdriver bit for screws with hex-head profiles. This screwdriver bit merely differs from the screwdriver bit according to FIGS. 29–31 due to the fact that it contains a front section 74 with a penetrating section 75 this is provided with a conventional hexagonal profile. The various other parts are identical, which is the reason identical components are identified by the same reference symbols in FIG. 32 as in FIGS. 29–31. A continuation is identified by the reference symbol 76. Regarding the dimensions of L0, L1, etc., the previous explanations regarding screwdriver bits for TORX® screws apply, and also with respect to their dimensions for achieving an optimal structure during the compression process illustrated in FIGS. 8 and 9. Particularly preferred dimensional ratios for front sections are as follows:

Type: Hexagonal with continuation
Nos.: 2.5–8 $L_1/L_0$ between 1.6 and 1.80
$L_1$/e between 1.15 and 1.35
Width across corners e=($d_0$)
$L_P/L_0$ between 1.25 and 1.45
Type: Hexagonal without continuation
Nos.: 2.5–8 $L_1$=LG; LG/$L_0$ between 1.9 and 3.0
Bit width $L_1$=LG; LG/e between 1.3 and 2.2
Width across corners e=($d_0$).

Figure 33:
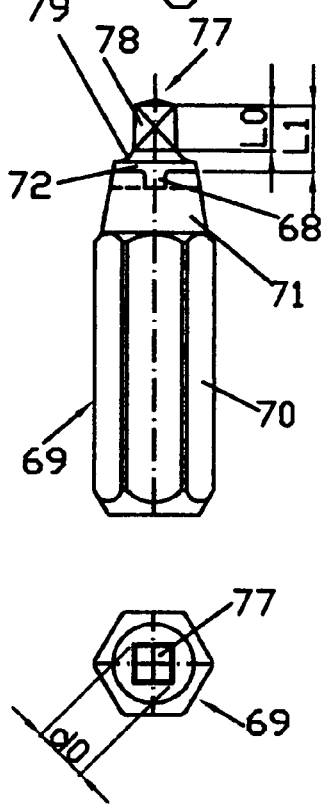
FIG. 33 is a side view and a front view of a screwdriver bit according to the invention for Robertson screws with continuation radius.

FIG. 33 shows a two-part screwdriver bit with a front section 77 that has a Robertson profile, wherein the front section contains a penetrating section 78 that has a square profile when viewed from the top. The front section 77 is connected to a base section along an arc-shaped continuation 79 that is curved radially outward, wherein the rear side of the base section is provided with an anchoring element 68 that is inserted and secured in the anchoring element 72, realized in the form of a recess, of the drive section 69 preferably made of normal tool steel. Since the arrangement is, except for the penetrating section 78, identical to that in FIGS. 31 and 32, identical components are again identified by the same reference symbols in order to simplify the illustration. Naturally, the transition section 71 may, for example, be shaped differently depending on the shape of the respective penetrating sections 60, 75 and 78.

With respect to the dimensions L0, L1, etc. (see FIG. 33), the previous explanations regarding the TORX® and hexagonal bits apply. Particularly preferred dimensional ratios for front sections are as follows:

Type: Square Robertson with continuation
Nos.: 0–3 $L_1/L_0$ between 1.7 and 1.96
$L_1$/e between 1.25 and 1.45
$L_P/L_0$ between 1.3 and 1.45
Width across corners e=($d_0$)
Type: Square Robertson without continuation
Nos.: 0–3 $L_1$=LG; LG/$L_0$ between 2.1 and 2.5
$L_1$=LG; LG/e between 1.6 and 1.85
Width across corners e=($d_0$).

Figure 34:
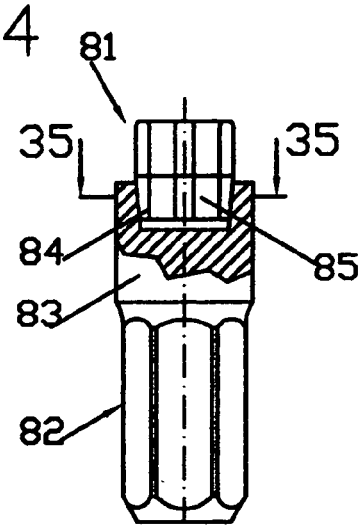
FIG. 34 is a side view of a screwdriver bit according to the invention for TORX® screws without continuation radii, wherein the diameter of the penetrating tip is greater than the diameter of the drive section.
Figure 35:
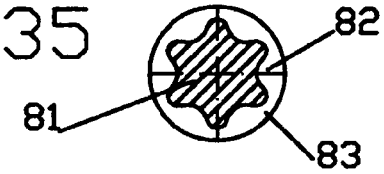
FIG. 35 is a section along line 35—35 in FIG. 34.

FIGS. 34 and 35 show a screwdriver bit with a front section 81 of hard metal that is realized in the form of a TORX® profile over its entire length. The drive section 82 of steel contains a transition section 83 on the side that faces the front section 1, wherein said transition section is provided with an anchoring element 84 in the form of a concave recess, the interior cross section of which corresponds to the outside cross section of the front section 81. The anchoring element 85 of the front section 81 consists of its rear end section that extends conically and is pressed into the recess 84 of the drive section. This connection may be additionally secured by means of bonding or soldering. Instead of realizing the anchoring element 85 conically, it would also be conceivable that the anchoring element extends cylindrically, i.e., that its profile remain unchanged over the entire length of the section 81, as illustrated in FIGS. 36 and 37.

Figure 36:
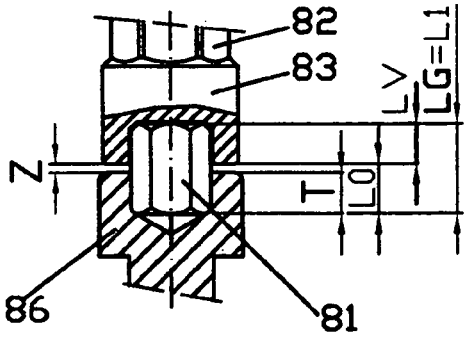
FIG. 36 is a side view of a screwdriver bit according to FIG. 34 with a corresponding screw head illustrated in sectioned form.
Figure 37:
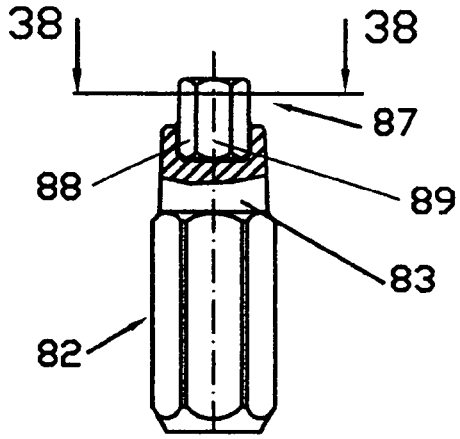
FIG. 37 is a partially sectioned side view of another screwdriver bit according to the invention for hex-head screws without continuation radii.
Figure 38:
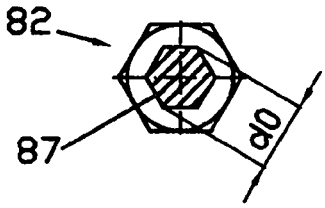
FIG. 38 is a cross-sectional view taken along line 38—38 in FIG. 37.

Similarly to FIG. 10, FIG. 36 schematically shows the front section 81 according to FIGS. 34 and 35 during its penetration into the profiled opening of the screw head 86 which has a penetrating depth T. FIGS. 37 and 38 show another screwdriver bit that, in contrast to FIG. 34, contains a front section 87 with a continuous hexagonal profile, i.e., this bit lacks the conical rear end section 85 of the front section according to FIG. 34. In this case, the rear end 89 that serves as the anchoring element 88 has the same profile as the front section that is intended to penetrate into the screw 86. The drive section 82 contains a recess with a hexagonal profile in the transition section 83, wherein the rear end 89 of the front section is fixed in said recess by means of pressing and/or soldering. Instead of providing the recess with a hexagonal profile, it would also be conceivable for the recess to have a round profile with a smaller diameter than the width across corners of the hexagonal profile. When the rear end 89 is pressed in, the corners of the hexagonal profile cut into the round profile such that durable anchoring is achieved. In contrast to the other described embodiments, the embodiments according to FIGS. 34–36 and 37, 38 are characterized by the fact that the front sections 81, 87 contain no continuation (e.g., 8 in FIG. 1) and no base section (e.g., 9 in FIG. 1), as well as no specially designed anchoring element 12 (FIG. 1) or 52 (FIG. 22). With respect to the front sections 81, 87, 93 according to FIGS. 34–38 and FIGS. 45 and 46, their total length consequently can be LG=L1 in the embodiment with continuation and a base section. In the two embodiments according to FIGS. 34–37 and 45, the total length by which the front section 81, 87, 93 projects from the transition section corresponds to the dimension $L_0$ in the embodiments with continuation according to FIGS. 1–25, 29–33, specifically because the penetrating section could penetrate into the screw head opening with the entire length by which it projects from the transition section, due to the lack of a continuation.

The relations described above with respect to the hexagonal profile apply analogously to the TORX® profile without continuation.

In order to ensure the uniform pressure distribution during the compression process that is carried out as illustrated in FIGS. 8 and 9 and that results in a rod-shaped pressed part with a TORX® or hexagonal profile, the dimension L1 (FIG. 36) should again be chosen to be as small as possible. As in the embodiments according to FIGS. 29–33, the maximum penetrating depth $T_{MAX}$ specified by the distributor of the TORX® system or hexagonal system is, according to the invention, assumed to be the penetrating depth required for achieving an optimal torque transmission. In FIG. 36, it is also assumed that this penetrating depth $T_{MAX}$ corresponds to the dimension T of the screw head 86, although the respective manufacturer usually specifies a dimension that is slightly larger or smaller than the dimension T in FIG. 36. Based on this value of $T_{MAX}$, a dimension L0 is defined which, if applicable, may be larger or smaller than the maximum penetrating depth $T_{MAX}$ by an allowance Z added in order to compensate for tolerances. This means that $L0=T_{MAX}+Z$ applies. Similarly to the already described embodiments, the dimension of L1 is then defined as no more than 2.5×L0, preferably no more than 2.2×L0. It is particularly advantageous if L1<2×L0. This implies that the dimension L0 is ultimately defined by the system or the stipulated or required penetrating depth T in all instances, and that the dimension L1 does not have to be significantly larger than the penetrating depth T in this case.

Corresponding dimensions apply to screwdriver bits with a Robertson profile.

Figure 45:
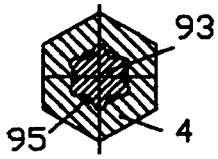
FIG. 45 is a cross-sectional view through the screwdriver bit according to FIG. 44 taken along line 45—45 in FIG. 44.

In front sections that have a uniform profile over their entire length, e.g., a TORX® profile or a hexagonal profile, as shown in FIGS. 36, 37, and 45, without continuation, the pressure distribution during compression of the pressed parts is more favorable than in instances in which the mold has varying profiles over the entire length. The total length LG that is composed of the length L0 and the length LV of the anchoring section consequently can be made longer in front sections with a uniform profile over the entire length than in front sections with a varying profile, without significantly deteriorating the homogeneity of the structure.

The greater length LG can, in particular, lead to a greater length LV, wherein L0 remains unchanged. Consequently, larger dimensions of LG in relation to L0 and of LG in relation to d0 are permissible if a superior durability of the screwdriver bit should still be achieved in the sense of the invention. According to the invention, these dimensions correspond to no more than LG=3×L0 and LG=2×d0, respectively, both for TORX® profiles as well as hexagonal profiles.

In one example of TORX® bits, the dimension $T_{MAX}$ for the size 15 is L0=2.16 mm, with L1=2.4 mm and LG approximately =5.0 mm. For the size 30, $T_{MAX}$=L0=3.18 mm, with L1=3.5 mm and LG approximately =8.0 mm. For the size 50, $T_{MAX}$=L0=4.57 mm, with L1=5.05 mm and LG approximately =11.1 mm. Particularly preferred dimensions are provided above. In one particularly preferred embodiment of the screwdriver bits according to FIGS. 34–38, the cross section of the front section 81, 87 is increased by approximately 0.1–0.2 mm in the region of the length LV. The front section 81, 87 can, after being ejected by the length LV, be removed from the mold without friction such that the entire process of removing the pressed part from the mold is simplified.

Anchoring elements that are realized such that a rigid connection is achieved solely by means of a self-locking effect or a positive fit while pressing together the front section and the shaft section, and that are suitable for transmitting torques, are characterized by the fact that on the rear side of the front section the anchoring element extends conically from base to end at an angle α that corresponds to no more than the self-locking angle of the materials and surfaces used. Analogously, the recess in the end surface of the shaft section extends conically. The cross sections of the anchoring elements may have a noncircular or circular profile.

Anchoring elements of this type cannot only be used on bits in which the front section has a highly conical tip, e.g., the tip of cross-tip bits, and in which the base that is directed toward the shaft section has a greater diameter than the tip, but also on front sections that have a linearly extending profile in the axial direction, for example, a profile for TORX® screws or hex-head screws. In order to connect the front section and the shaft section, the profile of the front section extends over its entire length in such bits, i.e., it also engages into the recess on the front end surface of the shaft section. In this case, the recess has the same cross-sectional profile as the front section. In a conical connection, the profile of the front section extends conically over a length that is intended for the anchoring in the recess of the shaft section, and the recess has the same conicity plus an allowance for compensating tolerances such that a rigid pressed connection is achieved. In case of a positive connection, a round recess is realized and the profile of the front section cuts into the wall of the recess with the shaft section while the two parts are pressed together.

Embodiments of such connections are illustrated in FIGS. 39–45.

Figure 39:
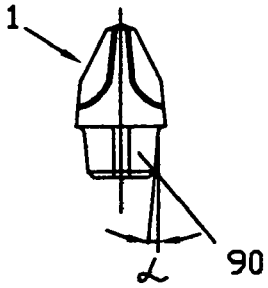
FIG. 39 is a side view of a front section according to the invention with a conically extending noncircular anchoring element.

FIG. 39 shows a side view of a front section according to the invention with a conically extending noncircular anchoring element, where (1) is the front section and (90) is the anchoring element that conically extends at an angle α.

Figure 40:
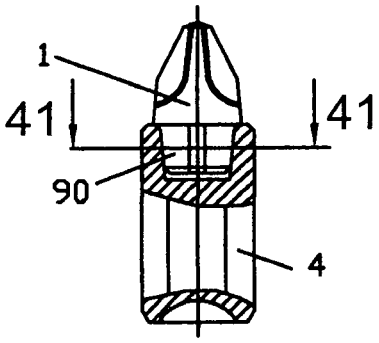
FIG. 40 is a side view of a screwdriver bit according to the invention with a conically extending noncircular anchoring element, in the form of a partial section.

FIG. 40 shows the assembled screwdriver bit, where the front section 1 according to FIG. 39 with the conical anchoring element 90 is pressed into the conical recess in the shaft section 4.

Figure 41:
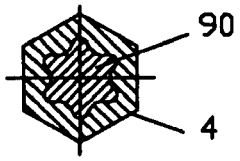
FIG. 41 is a cross-sectional view through the screwdriver bit according to FIG. 40 taken along line 41—41 in FIG. 40.

FIG. 41 shows a cross section through this screwdriver bit along line 41—41 in FIG. 40.

Figure 42:
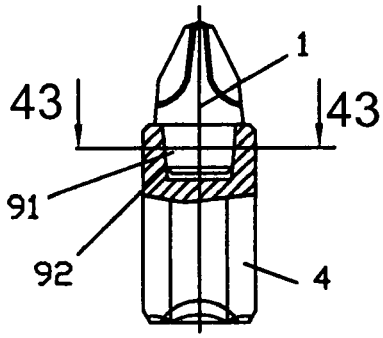
FIG. 42 is a side view of a screwdriver bit according to the invention with a conically extending round anchoring element.

FIG. 42 shows a screwdriver bit that corresponds to the one shown in FIG. 40, but with a round anchoring element 91 that engages into a corresponding conical recess 92 in the shaft section 4.

Figure 43:
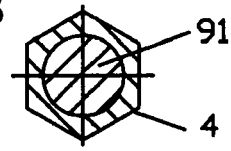
FIG. 43 is a cross-sectional view of the screwdriver bit according to FIG. 42 taken along line 43—43 in FIG. 42.

FIG. 43 shows a cross section through this screwdriver bit along line 43—43 in FIG. 42.

Figure 44:
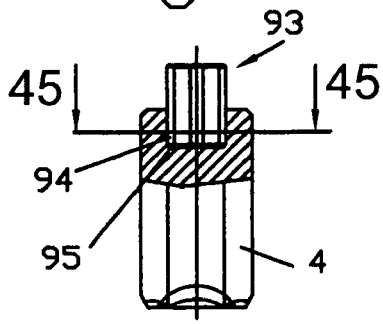
FIG. 44 is a side view of a screwdriver bit according to the invention with a partially sectioned front section, wherein the front section has a profile that continuously extends over the entire length in a uniform fashion.

FIG. 44 shows a screwdriver according to the invention with a front section 93 that has a uniform profile 94 over its entire length, where the front section is pressed into a round recess 95 in the shaft section 4, where the edges of the profile 94 as an anchoring element are pressed into the wall of the recess 95 in the shaft section 4, and where the edges of the profile 94 have cut into the wall of the recess.

FIG. 45 shows a cross section through the screwdriver bit according to FIG. 44, where the cut-in edges of the profile 94 and the remaining arc-shaped sections 96 of the wall of the recess 95 are visible.

In contrast to one-piece screwdriver bits that are manufactured, for example, by means of injection molding (e.g., according to DE 42 41 005 A1), the described two-piece design provides the advantage that the small front section can be manufactured from a hard metal powder by means of a compression molding process such that it has a high dimensional accuracy and does not contain notches in the plane with the highest torsional load, i.e., in the plane of the front end surface of the drive section. Such notches would increase the risk of fractures due to stress concentrations. For example, the direct transition of the cruciform lands into the end surface in the one-piece design according to DE 42 41 005 A1 would be considered as such a notch.

The explanations regarding the cross-tip profiles also apply, in principle, to other profiles. However, with respect to the compression molding technique, profiles with a cross section that uniformly extends in the axial direction according to FIGS. 34–38 are more favorable than cross-tip profiles. This the reason a higher ratio of length to diameter is permissible in uniformly extending profiles. In addition, the diameter of the ejector die can be realized with a round cross section and/or nearly identical to the profile diameter. This results in more favorable conditions for introducing the ejector force into the pressed part.

With respect to the invention, this means that the ratio L1/d0 (FIG. 2) should be approximately 0.9–1.2, i.e., L1 and d0 are approximately equal. In TORX® profiles with continuation, L1/d0 ratios (FIGS. 29, 30) of approximately 0.9–1.4 proved to be practical, i.e., L1 may generally be slightly larger than d0 in this case. In hexagonal profiles with continuation, the most favorable ratios of L1 (FIG. 36) to d0 are approximately 1.4–1.9, where d0 is the width across corners in millimeters according to FIG. 38. In Robertson profiles, advantageous front sections have an L1/d0 ratio of approximately 1.3–1.5, where d0 is also the width across corners in millimeters (FIG. 33).

In the corresponding profiles without continuation, it is preferred that the ratios of length to diameter (or the width across corners d0) respectively refers to the total length LG according to FIG. 36. In TORX® profiles without continuation, LG/d0 may be, for example, approximately 1.25–2.2. In hexagonal profiles, advantageous LG/d0 ratios are approximately 1.3–2.1, where an LG/d0 ratio of approximately 1.5–2.0 proved advantageous for Robertson profiles. The respectively smallest value for L1/d0 or LG/d0 is respectively defined by the corresponding dimension of L1, where L1 cannot be less than L0.

The invention is not limited to the described embodiments that may be modified in different ways. This initially applies to the shape of the anchoring elements, where it would also be conceivable to utilize two or more anchoring elements per bit if these anchoring elements are realized, for example, in the form of several pins.

In addition, the described dimensions L0, L1, d0, etc., may be chosen differently than described above by way of example. The ratios of length to diameter should always specifically be chosen such that the smallest possible circumferential surfaces or contact surfaces with the pressing tool are achieved in order to create favorable frictional conditions and eliminate the need for high ejector forces. It is also possible to base the dimension of L0 on a value other than the greatest absolute penetrating depth. It would also be possible, e.g., to use the broadest $T_{MAX}/T_{MIN}$ range for this purpose, where the length L0 is chosen such that it corresponds to a dimension that lies approximately in the middle of this range. Although the penetrating sections d0 not fully penetrate the largest screws in such instances, the penetrating depth is still sufficiently deep for achieving adequate seating. The specific dimensions for individual cases can be easily determined on the basis of previous explanations, as well as by means of calculation and experiment. It was determined that the L/d0 ratio should preferably always be less than 2.2, in particular, less than 2.0. In bits with continuation, L1/d0 ratios which are even smaller than 1.5 proved to be particularly advantageous, where the dimension d0 is determined by the corresponding screw head. In addition, the short lengths of L1 and LG in accordance with the invention are not only advantageous during the compression molding process and the immediately ensuing sintering process, but also for front sections manufactured by means of injection molding. As in the compression molding method, a removal from the mold by means of an ejector is usually carried out in injection molding processes. Consequently, it is desirable to reduce the resistance to removal from the mold by reducing the length. In order to promote the injection molding process, the hard metal powder mixture contains a fraction of a thermoplastic fluxing agent (e.g., wax or plastic) that is extracted from the blank again before the sintering process. With respect to the homogenization of the bit structures, the chosen grain size composition of the hard metal powder mixture also proved to be an important factor. In this respect, grain variations in the mixture between 0.5 μm and 8 μm are particularly advantageous. Finally, it goes without saying that the different characteristics and dimensions may also be used in other combinations than those described above and illustrated in the figures.

What is claimed is:

1. A screwdriver bit comprising:

a drive section, said drive section having an end surface, and a front section, said front section being made from a hard-metal powder, said front section having an end surface, a mating surface opposing said end surface, a central axis extending between said end surface and said mating surface, and a profiled penetration section, said front section connected to said drive section such that said mating surface of said front section and said end surface of said drive section are adjacent to each other, said profiled penetration section extending between a base and a tip, said base adjacent said mating surface of said front section, said tip adjacent said end surface of said front section, said profiled penetration section including a body extending between said base and said tip, said body having a surface such that when said body is viewed in section taken along a plane extending through said central axis, said surface defines a pair of edges that are substantially linear, said front section having a front section length measured along said central axis between said mating surface of said front section and said end surface of said front section, said profiled penetration section having a penetration length measured along said central axis between said base and said tip of said profiled penetration section, and said profiled penetration section having a base diameter, said base diameter being measured at a base section in a plane perpendicular to said central axis and disposed along the central axis at said base of said profiled penetration section, said base section defining a base perimeter, said base diameter being of a circle circumscribing said base perimeter, wherein said front section length does not exceed 2.5 times said penetration length and the ratio of said front section length to said base diameter does not exceed 2.2.

2. The screwdriver bit according to claim 1 wherein said penetration length of said penetration section is selected according to a penetration depth for a predetermined type of screw head with a particular recess profile such that said penetration length is not longer than 1.1 times a maximum penetration depth of said recess in said screw head.

3. The screwdriver bit according to claim 1, wherein said penetration length of said penetration section is selected according to a penetration depth for a predetermined type of screw head with a particular recess profile such that said penetration length is at least equal to a maximum penetration depth of said recess in said screw head.

4. The screwdriver bit according to claim 1, wherein said front section length is less than 2.2 times said penetration length of said penetration section.

5. The screwdriver bit according to claim 1, wherein said front section length is less than 2 times said penetration length.

6. The screwdriver bit according to claim 1, wherein the profiled penetration section is selected from the group of sections consisting of H/Z, Torx®, hexagonal, and square Robertson, and the respective ratio of said front section length to said penetration length falls within the following values: 1.56 and 1.85 for H/Z, 1.65 and 1.9 for Torx®, 1.6 and 1.80 for hexagonal, and 1.7 and 1.96 for square Robertson.

7. The screwdriver bit according to claim 1, wherein the ratio of said front section length to said base diameter of said profiled penetration section is less than 2.

8. The screwdriver bit according to claim 1, wherein the ratio of said front section length to said base diameter of said profiled penetration section is less than 1.5.

9. The screwdriver bit according to claim 1, wherein the profiled penetration section is selected from the group of sections consisting of H/Z, Torx®, hexagonal, and square Robertson, and the respective ratio of said front section length to said base diameter of said profiled penetration section falls within the following values: 0.9 and 1.15 for H/Z, 0.95 and 1.29 for Torx®, 1.15 and 1.35 for hexagonal, and 1.25 and 1.45 for square Robertson.

10. The screwdriver bit according to claim 1, wherein said front section includes a continuation section and a base section, said continuation section disposed between said profiled penetration section and said base section, said base section including said mating surface.

11. The screwdriver bit according to claim 10, wherein said continuation section has a continuation length measured along said central axis, the ratio of said penetration length of the profiled penetration section combined with said continuation length of said continuation section to said penetration length is between 1.25 and 1.55.

12. The screwdriver bit according to claim 10, wherein said continuation section includes a concave, curved surface that extends between said base of said profiled penetration section and said base section.

13. The screwdriver bit according to claim 12, wherein said profiled penetration section includes a plurality of ribs that define a plurality of grooves therebetween, said grooves extending along said central axis, said continuation section having a plurality of concave, curved surfaces that correspond to the plurality of grooves such that a concave, curved surface is associated with each groove.

14. The screwdriver bit according to claim 1, wherein said front section includes a base section adjacent to said penetration section, said base section having a base length measured along said central axis of between 0.5 mm and 2.2 mm.

15. The screwdriver bit according to claim 1, wherein said mating surface of said front section defines an anchoring element, and said end surface of said drive section defines a complementary anchoring element, said anchoring elements configured to complementarily engage each other for connecting said front section and said drive section.

16. The screwdriver bit according to claim 15, wherein said anchoring element of said drive section comprises a recess, and said anchoring element of said front section comprises a protrusion, said anchoring elements having a cross-sectional profile that substantially corresponds to each other.

17. The screwdriver bit according to claim 15, wherein one of the anchoring elements comprises a protruding part and the other of the anchoring elements comprises a recess configured to accept the protruding part therein.

18. The screwdriver bit according to claim 15, wherein said anchoring element of said front section includes an outer surface that has a shape that substantially corresponds to the shape of said base perimeter.

19. The screwdriver bit according to claim 15, wherein said anchoring element of said front section has a tapered profile.

20. The screwdriver bit according to claim 1, wherein said front section includes a base section in direct contact with said profiled penetration section, said base section having a base length measured along said central axis, said profiled penetration section having a uniform cross section over its length, said base section having a uniform cross section over its length, said cross section of said base section being the same as said cross section of said profiled penetration section, and said base length combined with said penetration length does not exceed 3 times the penetration length.

21. The screwdriver bit according to claim 1, wherein said front section comprises a hard metal powder mixture with a grain size between 0.5 μm and 8 μm.

22. The screwdriver bit according to claim 21, wherein said front section comprises a tool steel.

23. The screwdriver bit according to claim 1, wherein said drive section comprises a tool steel.

* * * * *

UNITED STATES PATENT AND TRADEMARK OFFICE

CERTIFICATE OF CORRECTION

PATENT NO. : 7,168,348 B2
APPLICATION NO. : 10/441135
DATED : January 30, 2007
INVENTOR(S) : Horst Holland-Letz It is certified that error appears in the above-identified patent and that said Letters Patent is hereby corrected as shown below:

Claim 22, Column 20, Line 61, “claim 21” should read -- claim 1 --.

Signed and Sealed this

Eighteenth Day of September, 2007

JON W. DUDAS
*Director of the United States Patent and Trademark Office*